US012714139B2

(12) United States Patent
Kim et al.

(10) Patent No.: US 12,714,139 B2
(45) Date of Patent: Aug. 25, 2026

(54) AEROSOL GENERATING ARTICLE AND SYSTEM

(71) Applicant: KT&G CORPORATION, Daejeon (KR)

(72) Inventors: Min Kyu Kim, Seoul (KR); Dae Nam Han, Seoul (KR); Jong Sub Lee, Gyeonggi-do (KR); Byung Sung Cho, Gyeonggi-do (KR)

(73) Assignee: KT&G CORPORATION, Daejeon (KR)

( * ) Notice: Subject to any disclaimer, the term of this patent is extended or adjusted under 35 U.S.C. 154(b) by 438 days.

(21) Appl. No.: 18/270,778

(22) PCT Filed: Mar. 29, 2023

(86) PCT No.: PCT/KR2023/004193
§ 371 (c)(1),
(2) Date: Jul. 3, 2023

(87) PCT Pub. No.: WO2023/195679
PCT Pub. Date: Oct. 12, 2023

(65) Prior Publication Data

US 2024/0381927 A1 Nov. 21, 2024

(30) Foreign Application Priority Data

Apr. 4, 2022 (KR) ..... 10-2022-0041914

(51) Int. Cl.
*A24D 1/20* (2020.01)
*A24D 1/00* (2020.01)
(Continued)

(52) U.S. Cl.
CPC ..... *A24D 1/20* (2020.01); *A24D 1/002* (2013.01); *A24D 1/045* (2013.01); *A24D 3/0279* (2013.01);
(Continued)

(58) Field of Classification Search
CPC .. A24D 1/20; A24D 1/002; A24D 3/00; A24F 40/20
See application file for complete search history.

(56) References Cited

U.S. PATENT DOCUMENTS 1,993,728 A * 3/1935 Aivaz ..... A24D 3/0245 493/50
2011/0277781 A1* 11/2011 Clark ..... A24D 3/14 131/335
(Continued)

FOREIGN PATENT DOCUMENTS

EP 3 928 641 A1 12/2021
EP 4 140 338 A1 3/2023
(Continued)

OTHER PUBLICATIONS

Notice of Reasons for Refusal Office Action on Japanese Application No. 2023-554877 dated Aug. 19, 2024 (9 Pages).
(Continued)

*Primary Examiner* — Michael H. Wilson
*Assistant Examiner* — Stephanie Lynn Moore
(74) *Attorney, Agent, or Firm* — Foley & Lardner LLP

(57) ABSTRACT

An aerosol generating article includes a front-end plug configured to introduce external air into the aerosol generating article, a tobacco medium portion including a tobacco material in the form of granules, and a filter unit arranged at a position opposite the front-end plug across the tobacco medium portion, wherein the tobacco material has a pH value of 7 to 11. Other various embodiments may be identified by the disclosure.

9 Claims, 4 Drawing Sheets

(51) Int. Cl.

| | |
|---|---|
| ***A24D 1/04*** | (2006.01) |
| ***A24D 3/02*** | (2006.01) |
| ***A24D 3/06*** | (2006.01) |
| ***A24D 3/10*** | (2006.01) |
| ***A24D 3/17*** | (2020.01) |
| ***A24F 40/20*** | (2020.01) |

(52) U.S. Cl.

CPC ..... *A24D 3/061* (2013.01); *A24D 3/10* (2013.01); *A24D 3/17* (2020.01); *A24F 40/20* (2020.01)

(56) References Cited

U.S. PATENT DOCUMENTS

| | | | | |
|---|---|---|---|---|
| 2012/0138075 | A1* | 6/2012 | Jespersen | A24F 15/12 131/331 |
| 2014/0305448 | A1* | 10/2014 | Zuber | A24D 1/20 131/328 |
| 2014/0345634 | A1* | 11/2014 | Zuber | A24D 3/17 131/328 |
| 2017/0055576 | A1 | 3/2017 | Beeson et al. | |
| 2020/0163377 | A1* | 5/2020 | Franke | A24C 5/01 |
| 2021/0251280 | A1 | 8/2021 | Lord et al. | |

FOREIGN PATENT DOCUMENTS

| | | | |
|---|---|---|---|
| KR | 10-2019-0049135 | A | 5/2019 |
| KR | 10-2020-0007833 | A | 1/2020 |
| KR | 10-2020-0024926 | A | 3/2020 |
| KR | 10-2021-0138391 | A | 11/2021 |
| WO | 2021/215496 | A1 | 10/2021 |
| WO | 2021/260372 | A1 | 12/2021 |
| WO | 2022/039397 | A1 | 2/2022 |

OTHER PUBLICATIONS

Extended European Search Report issued May 8, 2024 in European Application No. 23730691.5.

International Search Report issued Jun. 28, 2023 in Application No. PCT/KR2023/004193.

Written Opinion of the International Searching Authority issued Jun. 28, 2023 in Application No. PCT/KR2023/004193.

* cited by examiner

AEROSOL GENERATING ARTICLE AND SYSTEM

CROSS REFERENCE TO RELATED APPLICATIONS

This application is a National Stage of International Application No. PCT/KR2023/004193, filed Mar. 29, 2023, claiming priority to Korean Patent Application No. 10-2022-0041914, filed Apr. 4, 2022.

TECHNICAL FIELD

The disclosure relates to an aerosol generating article and system including a tobacco material in the form of granules.

BACKGROUND ART

Recently, the demand for alternative methods to overcome the shortcomings of general cigarettes has increased. For example, there is an increasing demand for a system for generating aerosol by heating cigarettes or an aerosol generating material by using an aerosol generating apparatus, rather than by burning cigarettes.

However, an aerosol generating material generated by existing methods has a small amount of nicotine delivery when heated at a low temperature or unheated. In this regard, recently, research has been actively conducted to increase an amount of nicotine delivery when the aerosol generating material is heated at a low temperature heating or not heated, by changing physical properties of an aerosol generating material.

DISCLOSURE OF INVENTION

Technical Problem

When an aerosol generating material having changed physical properties is provided as a separate article other than an aerosol generating article (e.g., a stick-type cigarette), nicotine may be continuously released from the corresponding article to the outside even while a user is not actually smoking. In other words, when the aerosol generating material having the changed physical properties is provided as the separate article rather than the aerosol generating article, an amount of nicotine delivery may significantly decrease in the second half compared to the first half after opening the corresponding article. Accordingly, smoking satisfaction that the user may feel in the first half and the second half after opening the corresponding article may be different from each other.

Accordingly, various embodiments provide an aerosol generating article and system including an aerosol generating material in the form of granules.

The technical problems to be solved by the disclosure are not limited to the technical problems as described above, and other technical problems may be derived from the embodiments described hereinafter.

Solution to Problem

According to an aspect of the disclosure, an aerosol generating article includes a front-end plug configured to introduce external air into the aerosol generating article, a tobacco medium portion including a tobacco material in the form of granules, and a filter unit arranged at a position opposite to the front-end plug across the tobacco medium portion, wherein the tobacco material has a pH value of 7 to 11.

According to another aspect of the disclosure, an aerosol generating system includes an aerosol generating article, and an aerosol generating device including an accommodation space for accommodating the aerosol generating article.

A means for solving the problems is not limited to the above description, and may include all matters that may be inferred by a person skilled in the art throughout the description.

Advantageous Effects of Invention

According to various embodiments, an amount of nicotine delivery of a non-heating type aerosol generating article may increase by adjusting pH of a tobacco material.

In addition, according to various embodiments, an aerosol generating article including a tobacco material may be easily stored and kept by adjusting pH of the tobacco material, off-flavor may not occur from the tobacco material within the range of adjusted pH, and thus an improved smoking taste may be provided to the user.

The effects of the disclosure are not limited to the above-described effects, and may include all effects that may be derived from components described below.

BEST MODE FOR CARRYING OUT THE INVENTION

Regarding the terms in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, terms which can be arbitrarily selected by the applicant in particular cases. In such a case, the meaning of the terms will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and can be implemented by hardware components or software components and combinations thereof.

As used herein, a "tobacco material" may refer to any form of material including ingredients derived from tobacco plants. For example, the tobacco material may include tobacco grains or tobacco powder.

In addition, an "aerosol generating article" may refer to an article used by a user to smoke. For example, an aerosol generating article may be a cigarette that is directly burned by an aerosol generating device, a non-heating type cigarette that is not required to be heated for use, or a cigarette that is heated at a low temperature for use.

Although the terms first, second, etc. may be used herein to describe various elements, these elements should not be limited by these terms. These terms are only used to distinguish one element from another element.

Hereinafter, the present disclosure will now be described more fully with reference to the accompanying drawings, in which exemplary embodiments of the present disclosure are shown such that one of ordinary skill in the art may easily work the present disclosure. The present disclosure may be implemented in a form that can be implemented in the aerosol generating devices of the various embodiments described above or may be implemented in various different forms, and is not limited to the embodiments described herein.

Hereinafter, embodiments will be described in detail with reference to the drawings.

Figure 1:
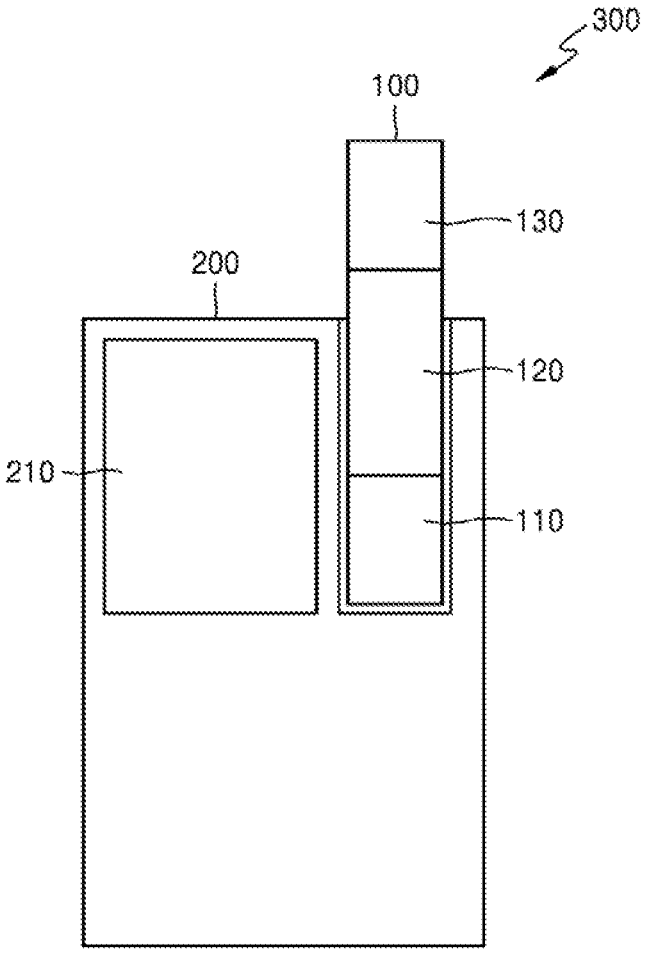
FIG. 1 is a diagram illustrating an aerosol generating system according to an embodiment.

FIG. 1 is a diagram illustrating an aerosol generating system according to an embodiment.

Referring to FIG. 1, an aerosol generating system 300 may include an aerosol generating article 100 and an aerosol generating device 200. In an embodiment, the aerosol generating device 200 may include an accommodation space for accommodating the aerosol generating article 100. In addition, the aerosol generating device 200 may include a separate component (e.g., a cartridge 210) including a liquid material.

In an embodiment, the aerosol generating article 100 may include a front-end plug 110, a tobacco medium portion 120, and a filter unit 130. In detail, the front-end plug 110, the tobacco medium portion 120, and the filter unit 130 may be sequentially arranged in a longitudinal direction of the aerosol generating article 100. In addition, the aerosol generating article 100 may further include other general-purpose components, in addition to the components shown in FIG. 1.

In an embodiment, the front-end plug 110 may introduce external air into the aerosol generating article 100. In the disclosure, when the aerosol generating article 100 is an unheated aerosol generating article, the front-end plug 110 may introduce aerosol, which is generated by heating a separate component (e.g., the cartridge 210 including a liquid material), as external air into the aerosol generating article 100. Here, the liquid material, which may be included in the separate component, may be a liquid including a tobacco-containing material including a volatile tobacco flavor component, or may be a liquid including a non-tobacco material.

For example, the liquid material, which may be included in the separate component, may include water, solvents, ethanol, plant extracts, spices, flavorings, or vitamin mixtures. The spices may include menthol, peppermint, spearmint oil, various fruit-flavored ingredients, and the like, but are not limited thereto. The flavorings may include ingredients capable of providing various flavors or tastes to a user. The vitamin mixtures may be a mixture of at least one of vitamin A, vitamin B, vitamin C, and vitamin E, but are not limited thereto. In addition, the liquid material may include an aerosol forming substance, such as glycerin and propylene glycol.

In an embodiment, the front-end plug 110 may include one of an acetate filter formed of cellulose acetate tow and a paper filter formed of paper. Here, when the front-end plug 110 includes an acetate filter formed of cellulose acetate tow, the front-end plug 110 may be manufactured to generate flavors.

For example, when the front-end plug 110 includes an acetate filter, a flavoring liquid including a flavoring material may be injected onto the acetate filter, and an additional fiber coated with the flavoring liquid may be included inside the acetate filter. As another example, when the front-end plug 110 includes an acetate filter, the acetate filter may include a capsule including a flavoring material.

The flavoring material may include menthol, but is not limited thereto.

For example, the flavoring material may also include vegetable spices, such as cinnamon, sage, herbs, chamomile, winter hay, licorice, lavender, bergamot, lemon, orange, cinnamon, jasmine, ginger, vanilla, spearmint, peppermint, acacia, coffee, celery, sandalwood, and cocoa.

As another example, the flavoring material may include animal spices, such as musk, ambergris, sherbet, and castoreum.

As another example, the flavoring material may also be an alcoholic compound, such as geraniol, linalool, anethol, or eugenol. The flavoring material may be an aldehyde compound, such as vanillin, benzaldehyde, or anisaldehyde. The flavoring material may be an ester compound, such as isoamyl acetate, linalyl acetate, isoamyl propionate, or butyric acid linalyl.

In an embodiment, the tobacco medium portion 120 may include a tobacco material in the form of granules. Here, the tobacco material in the form of granules may have a diameter of about 0.1 mm to about 1.2 mm. Preferably, the tobacco material in the form of granules may have a diameter of about 0.3 mm to about 0.6 mm.

In an embodiment, the tobacco material may include various types of tobacco particles.

For example, the tobacco particles may be tobacco leaf pieces, tobacco stems, and/or tobacco fine powder generated during tobacco treatment. The tobacco particles may include ground tobacco leaves, ground reconstituted tobacco, or the like. For example, the tobacco particles may include at least one type of tobacco powder from among flue-cured powder, burley powder, fire-cured powder, sun-cured powder, and air-cured powder.

In an embodiment, the tobacco material may include a pH regulator that adjusts pH of the tobacco material to the alkali side.

For example, the pH regulator may include at least one of potassium carbonate ($K_2CO_3$), sodium hydrogen carbonate ($NaHCO_3$), and a mixture thereof, but is not limited thereto. As the pH of the tobacco material is adjusted to the alkali side through the pH regulator, the aerosol generating article 100 may deliver a sufficient amount of nicotine even at a low temperature even when not directly heated by a separate heating element.

In an embodiment, a pH value of the tobacco material may be adjusted through the pH regulator. For example, the pH value of the tobacco material may be about 7 to about 11. Preferably, the pH value of the tobacco material may be about 8 to about 9.

As the pH of the tobacco material is adjusted to the alkali side (i.e., as the pH value of the tobacco material increases) through the pH regulator, an amount of nicotine delivery of the tobacco material may gradually increase. In other words, when the aerosol generating article 100 is a non-heating type aerosol generating article and the pH of the tobacco material is not adjusted to the alkali side (i.e., when the pH of the tobacco material is close to slightly acid), a rate at which nicotine is released at a low temperature may be low, and thus, an amount of nicotine delivered may be small. Accordingly, the user's satisfaction with smoking may be impaired.

On the other hand, when the pH value of the tobacco material is overly high, nicotine may be continuously released from the tobacco material during storage of the aerosol generating article 100, and thus an actual amount of nicotine delivery may decrease when the aerosol generating article 100 is actually used later.

In addition, when the pH value of the tobacco material is excessively high, off-flavor may be generated from the aerosol generating article 100 and the taste of smoking felt by the user may be impaired. Accordingly, when the aerosol generating article 100 is a non-heating type aerosol generating article, the amount of nicotine delivery and the user's satisfaction with smoking may be improved at a pH value of about 7 to about 11, preferably, about 8 to about 9. A detailed description thereof will be described below with reference to FIG. 6.

In an embodiment, the tobacco material may not include a binder for adjusting the overall particle size, porosity, and the like of the tobacco material.

For example, if the tobacco material is manufactured through a mixing operation of raw materials for the tobacco material, an extrusion operation (e.g., a wet extrusion method or a dry extrusion method), and a subsequent spheronization operation via a rotary plate, the particle size, porosity, and the like of granules of the tobacco material may be adjusted through a series of operations described above. In other words, although a binder is omitted when manufacturing a tobacco material in the form of granules, the particle size, porosity, and the like of granules may be adjusted. Therefore, materials needed for manufacturing a tobacco material according to the disclosure may be reduced, and thus manufacturing costs may be reduced.

In an embodiment, the tobacco medium portion 120 may include at least one of an acetate filter formed of cellulose acetate tow and a paper filter formed of paper.

For example, when the tobacco medium portion 120 includes at least one of an acetate filter and a paper filter, a tobacco material in the form of granules may be filled inside the filter. Here, the tobacco material may be filled with about 2 mg/mm to about 8 mg/mm inside the filter. Preferably, the tobacco material may be filled with about 4 mg/mm to about 6 mg/mm inside the filter.

When the pH of the tobacco material included in the tobacco medium portion 120 is adjusted to the alkali side through the pH regulator, an amount of nicotine released from the tobacco material at a low temperature may increase. Accordingly, when the tobacco medium portion 120 is formed by filling at least one of the acetate filter and the paper filter with a tobacco material having adjusted pH, nicotine released from the tobacco material may be absorbed by and maintained in the acetate filter or the paper filter. Thus, the released nicotine may be prevented from being released to the outside of the aerosol generating article 100. A detailed description thereof will be described below with reference to FIGS. 4 and 5.

In an embodiment, the filter unit 130 may be arranged at a position opposite to the front-end plug 110 across the tobacco medium portion 120. The filter unit 130 may filter one or more materials included in mainstream smoke including aerosol generated from the tobacco medium portion 120.

In an embodiment, the filter unit 130 may be implemented in various shapes. For example, the filter unit 130 may be a cylinder-type rod or a tube-type rod including a hollow therein. Alternatively, the filter unit 130 may also be a recess-type rod.

In an embodiment, the filter unit 130 may include one of an acetate filter formed of cellulose acetate tow and a paper tube filter formed of paper. Here, when the filter unit 130 includes the acetate filter formed of cellulose acetate tow, the filter unit 130 may be manufactured to generate flavors.

For example, when the filter unit 130 includes the acetate filter, a flavoring liquid including a flavoring material may be injected onto the acetate filter, and a separate fiber coated with the flavoring liquid may be included in the acetate filter. As another example, when the filter unit 130 includes the acetate filter, the acetate filter may include a capsule including a flavoring material. A flavoring material, which may be included in the filter unit 130, may be the same as or similar to a flavoring material that may be included in the front-end plug 110.

In an embodiment, one of the front-end plug 110 and the filter unit 130 may include a flavoring material.

For example, when the front-end plug 110 may include a capsule including a flavoring material or may include a fiber coated with a flavoring liquid including a flavoring material, the filter unit 130 may not include a flavoring material. In other words, when the front-end plug 110 includes a flavoring material, the filter unit 130 may include a recess-type rod formed of cellulose acetate tow, or may include a paper tube formed of paper.

As another example, when the filter unit 130 includes a capsule including a flavoring material or a fiber coated with a flavoring liquid including a flavoring material, the front-end plug 110 may not include a flavoring material. In other words, when the filter unit 130 includes a flavoring material, the front-end plug 110 may include an acetate filter formed of cellulose acetate tow, or may include a paper tube formed of paper.

The aerosol generating article 100 may be manufactured in a cylindrical shape. In this case, the aerosol generating article 100 may have a length of about 20 mm to about 60 mm. For example, the front-end plug 110 may have a length of about 5 mm to about 15 mm, the tobacco medium portion 120 may have a length of about 10 mm to about 30 mm, and the filter unit 130 may have a length of about 5 mm to about 15 mm. However, the lengths of the aerosol generating article 100 and the elements constituting the same are not limited thereto, and may be variously changed according to the design of a manufacturer.

Figure 2:
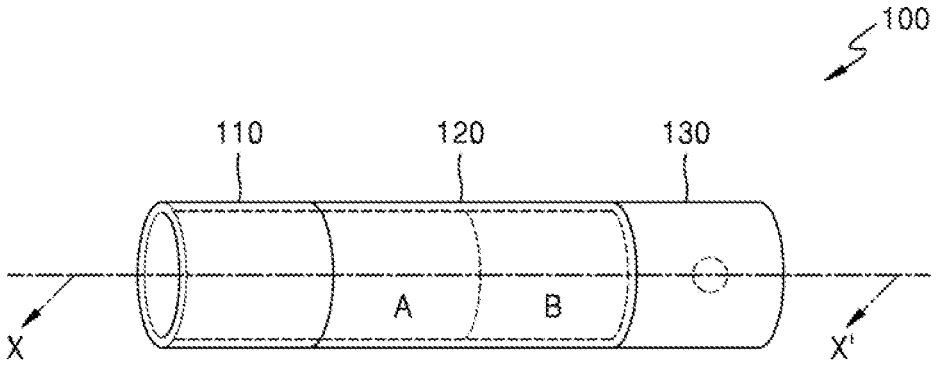
FIG. 2 is a view illustrating an aerosol generating article including a tobacco medium portion having two segments, according to an embodiment.
Figure 3A:
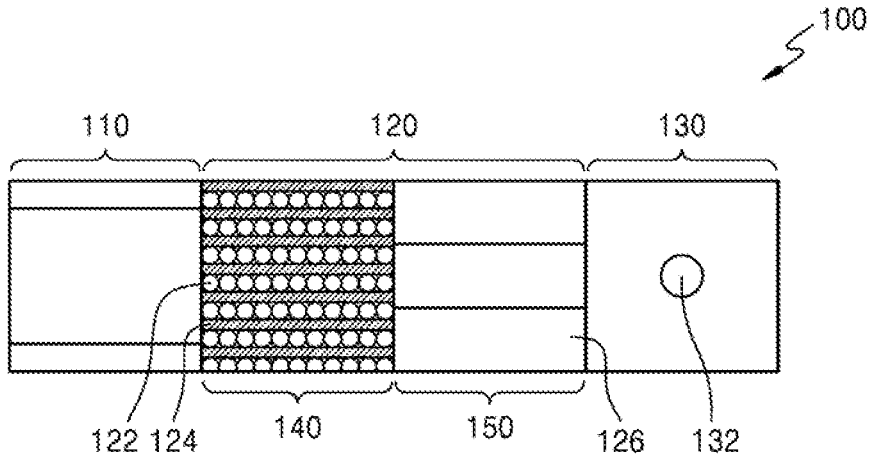
FIGS. 3A to 3C are cross-sectional views of an aerosol generating article taken in a longitudinal direction along line X-X' according to an embodiment.
Figure 3B:
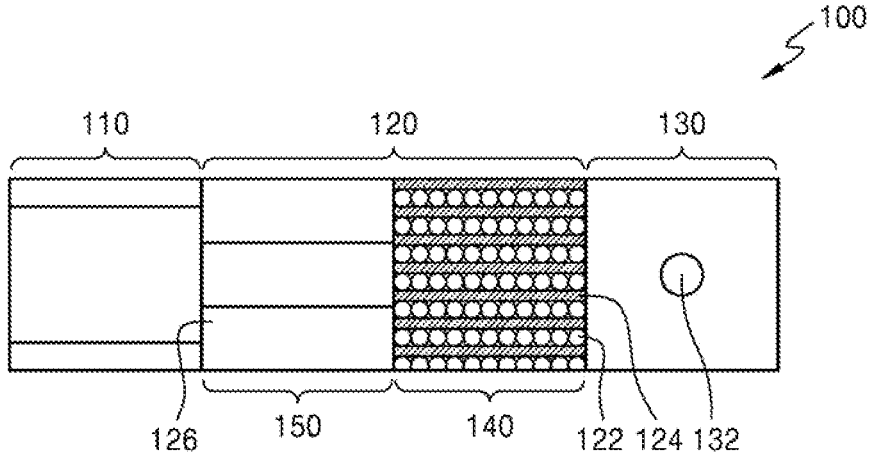
Figure 3C:
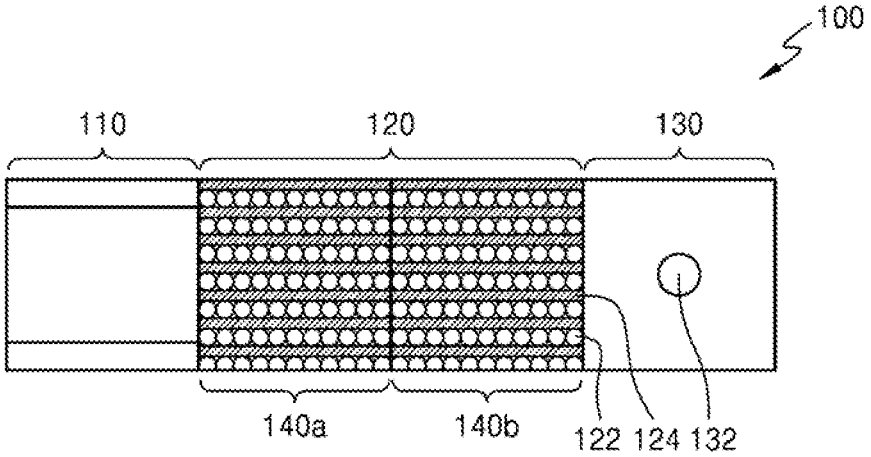

FIG. 2 is a view illustrating an aerosol generating article including a tobacco medium portion having two segments, according to an embodiment. FIGS. 3A to 3C are cross-sectional views of an aerosol generating article taken in a longitudinal direction along line X-X' according to an embodiment.

Referring to FIG. 2, an aerosol generating article 100 may include a front-end plug 110, a tobacco medium portion 120, and a filter unit 130. FIG. 2 illustrates that the front-end plug 110 includes a paper filter (e.g., a paper tube) formed of paper, and the filter unit 130 includes an acetate filter including a capsule 132 including a flavoring material, but the disclosure is not limited thereto. In another embodiment, the front-end plug 110 may include an acetate filter including the capsule 132 including a flavoring material, and the filter unit 130 may include a recess-type rod formed of cellulose acetate tow.

In an embodiment, the tobacco medium portion 120 may include two segments including different elements, respectively. For example, the tobacco medium portion 120 may include a first segment 140 including a tobacco material 122, and a second segment 150 including a cooling element 126. Here, the cooling element 126 may correspond to any one of a tube filter or a paper tube filter, and a suction resistance of the aerosol generating article 100 may be reduced via the cooling element 126.

Referring to FIGS. 2 and 3A, the first segment 140 including the tobacco material 122 may be arranged in section A of the tobacco medium portion 120, and the second segment 150 including the cooling element 126 may be arranged in section B of the tobacco medium portion 120. Therefore, external air introduced through the front-end plug 110 may be mixed with components, such as nicotine released from the tobacco material 122 of the first segment 140, and then may sequentially proceed to the second segment 150 and the filter unit 130.

Referring to FIGS. 2 and 3B, the second segment 150 including the cooling element 126 may be arranged in the section A of the tobacco medium portion 120, and the first segment 140 including the tobacco material 122 may be arranged in the section B of the tobacco medium portion 120. Therefore, external air, which is introduced through the front-end plug 110, may be lowered in a temperature thereof through the cooling element 126 of the second segment 150, and then may sequentially proceed to the first segment 140 and the filter unit 130.

Here, the first segment 140 may be manufactured by filling a paper filter 124 with the tobacco material 122 in the form of granules, but is not limited thereto. The first segment 140 may also be manufactured by filling an acetate filter with the tobacco material 122 in the form of granules, and a detailed description thereof will be described below with references to FIGS. 4 and 5.

In an embodiment, the tobacco medium portion 120 may include two segments including the same element. For example, each of a first segment 140*a* and a second segment 140*b* of the tobacco medium portion 120 may include the tobacco material 122.

Referring to FIGS. 2 and 3C, the first segment 140*a* including the tobacco material 122 may be arranged in the section A of the tobacco medium portion 120, and the second segment 140*b* including the tobacco material 122 may be arranged in the section B of the tobacco medium portion 120. In an embodiment, the first segment 140*a* may be manufactured by filling an acetate filter with the tobacco material 122, and the second segment 140*b* may be manufactured by filling a paper filter with the tobacco material 122.

However, the manufacture of segments as described above is only an embodiment, and is not limited thereto. In an embodiment, the first segment 140*a* may be manufactured by filling a paper filter with the tobacco material 122, and the second segment 140*b* may be manufactured by filling an acetate filter with the tobacco material 122. In addition, both of the first segment 140*a* and the second segment 140*b* may be manufactured by filling an acetate filter with the tobacco material 122, or may be manufactured by filling a paper filter with the tobacco material 122.

Figure 4:
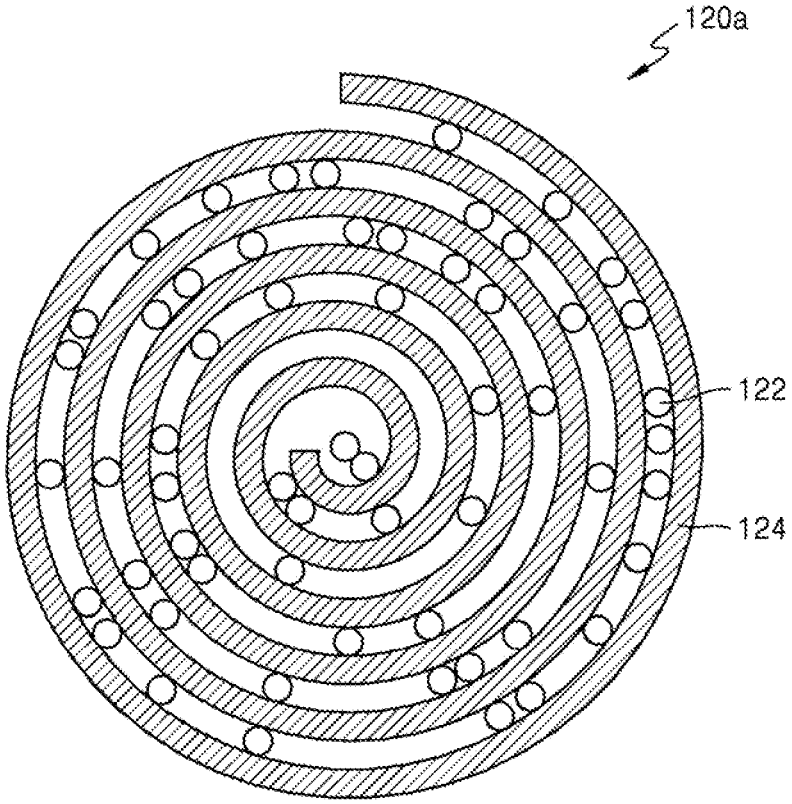
FIG. 4 is a cross-sectional view of a tobacco medium portion according to an embodiment.

FIG. 4 is a cross-sectional view of a tobacco medium portion according to an embodiment.

Referring to FIG. 4, a tobacco medium portion 120*a* of an aerosol generating article (e.g., the aerosol generating article 100 of FIG. 1) may include a paper filter 124 and a tobacco material 122 filled in the paper filter 124. For example, the paper filter 124 may be formed to have a rolled paper shape, and the tobacco material 122 may be filled in a gap between sheets of rolled paper.

In an embodiment, the tobacco material 122 may be filled with about 2 mg/mm to about 8 mg/mm inside the paper filter 124. Preferably, the tobacco material 122 may be filled with about 4 mg/mm to about 6 mg/mm inside the paper filter 124.

For example, when the tobacco medium portion 120*a* includes one segment including the tobacco material 122, like a tobacco medium portion as shown in FIG. 3A or 3B, and the one segment has a length of about 5 mm to about 15 mm, the tobacco medium portion 120*a* may be filled with the tobacco material 122 of about 20 mg to about 90 mg.

As another example, when the tobacco medium portion 120*a* includes two segments including the tobacco material 122, like a tobacco medium portion as shown in FIG. 3C, and the two segments have a length of about 10 mm to about 30 mm, the tobacco medium portion 120*a* may be filled with the tobacco material 122 of about 40 mg to about 180 mg.

In an embodiment, the paper filter 124 may be manufactured in a form in which paper having a smooth surface is rolled. However, the paper filter 124 is not limited thereto, and in an embodiment, the paper filter 124 may be manufactured in a form in which paper having a surface roughness greater than or equal to a certain value or crimped paper is rolled.

In an embodiment, the paper filter 124 may be manufactured in a form in which paper having a horizontal length of about 5 mm to about 15 mm and a vertical length of about 100 mm to about 150 mm is rolled. However, the disclosure is not limited thereto, and the size of paper may be variously changed according to the design of a manufacturer.

In an embodiment, the tobacco material 122 may have the form of granules, and the granules may have a diameter of about 0.1 mm to about 1.2 mm. Preferably, the granules may have a diameter of about 0.3 mm to about 0.6 mm. When the tobacco material 122 has a diameter within a range of about 0.1 mm to about 1.2 mm, preferably within a range of about 0.3 mm to about 0.6 mm, the ease of manufacture of the tobacco medium portion 120*a* may increase.

In other words, when the paper filter 124 is formed in the form of rolled paper and simultaneously the paper filter 124 is filled with the tobacco material 122 to manufacture the tobacco medium portion 120*a*, the tobacco material 122 needs to have a diameter within the range of about 0.1 mm to about 1.2 mm, preferably within the range of about 0.3 mm to about 0.6 mm, to be stably filled in the paper filter 124.

In an embodiment, when pH of the tobacco material 122 is adjusted to the alkali side via a pH regulator, the tobacco material 122 may release nicotine at a substantially lower temperature (e.g., about 25° C. to about 120° C.) than a temperature (e.g., higher than or equal to about 200° C.) at which the tobacco material 122 is heated by a heating element. Here, nicotine released from the tobacco material 122 is absorbed by the paper filter 124 (or release of nicotine from the tobacco material 122 is inhibited by the paper filter 124), and thus storage stability of an aerosol generating article (e.g., the aerosol generating article 100 of FIG. 1) may be improved.

Figure 5:
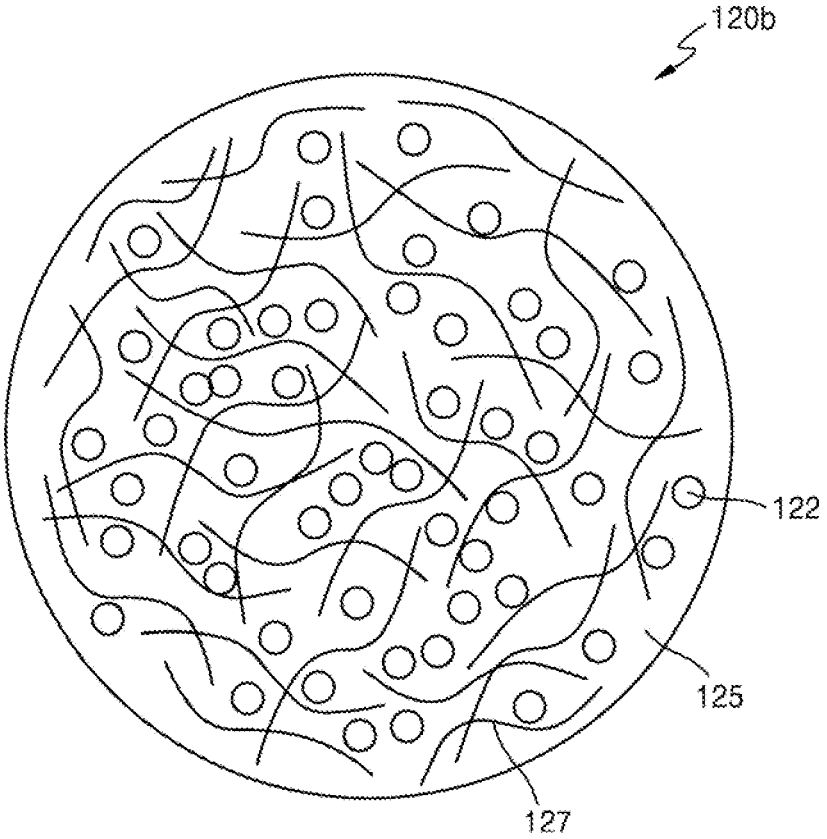
FIG. 5 is a cross-sectional view of a tobacco medium portion according to another embodiment.

FIG. 5 is a cross-sectional view of a tobacco medium portion according to another embodiment.

Referring to FIG. 5, a tobacco medium portion 120*b* of an aerosol generating article (e.g., the aerosol generating article 100 of FIG. 1) may include an acetate filter 125 and a tobacco material 122 filled in the acetate filter 125. For example, the acetate filter 125 may be formed of a plurality of cellulose acetate tows 127, and the tobacco material 122 may be filled between the plurality of cellulose acetate tows 127.

In an embodiment, the tobacco material 122 may be filled with about 2 mg/mm to about 8 mg/mm inside the acetate filter 125. Preferably, the tobacco material 122 may be filled with about 4 mg/mm to 6 mg/mm in the acetate filter 125.

In an embodiment, the acetate filter 125 may be formed of a plurality of cellulose acetate tows having a mono denier of 9.0, a total denier of 25000, and a cross-sectional shape of Y, but is not limited thereto.

In an embodiment, the tobacco material 122 may have the form of granules, and the granules may have a diameter of about 0.1 mm to about 1.2 mm. Preferably, the granules may have a diameter of about 0.3 mm to about 0.6 mm. When the tobacco material 122 has a diameter within a range of about 0.1 mm to about 1.2 mm, preferably, within a range of about 0.3 mm to about 0.6 mm, the case of manufacture of the tobacco medium portion 120*b* may increase.

In other words, when the acetate filter 125 is manufactured by combining the plurality of cellulose acetate tows 127 and simultaneously, the tobacco material 122 is filled in the acetate filter 125 to manufacture the tobacco medium portion 120*b*, the tobacco material 122 needs to have a diameter within a range of about 0.1 mm to about 1.2 mm, preferably, within a range of about 0.3 mm to about 0.6 mm, to be stably filled in the acetate filter 125.

In an embodiment, when pH of the tobacco material 122 is adjusted to the alkali side via a pH regulator, the tobacco material 122 may release nicotine at a substantially lower temperature (e.g., about 25° C. to about 120° C.) than a temperature (e.g., higher than or equal to about 200° C.) at which the tobacco material 122 is heated by a heating element.

Here, nicotine released from the tobacco material 122 is absorbed by the acetate filter 125 (or release of nicotine from the tobacco material 122 is inhibited by the acetate filter 125), and thus storage stability of an aerosol generating article (e.g., storage of the aerosol generating article 100 of FIG. 1) may be improved.

Figure 6:
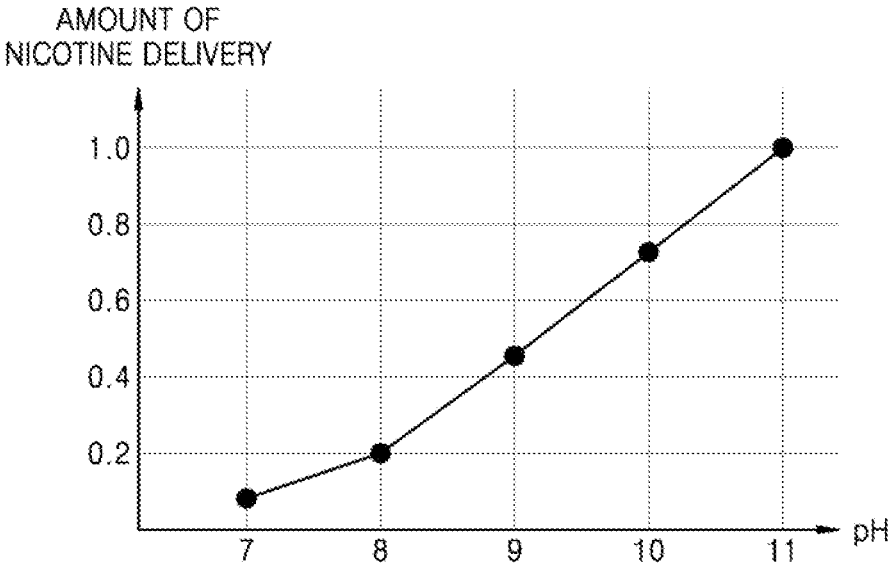
FIG. 6 illustrates a graph of an amount of nicotine delivery according to pH of an aerosol generating article, according to an embodiment.

FIG. 6 illustrates a graph of an amount of nicotine delivery according to pH of an aerosol generating article, according to an embodiment.

Referring to FIG. 6, when an aerosol generating article (e.g., the aerosol generating article 100 of FIG. 1) is a non-heating type aerosol generating article, an amount of nicotine delivered from the aerosol generating article 100 increases with an increase in pH of a tobacco material (e.g., the tobacco material 122 of FIGS. 3A to 3C) in the aerosol generating article 100. In other words, when the pH of the tobacco material 122 is higher than or equal to 7, nicotine may start to be delivered from the aerosol generating article 100 in a low temperature condition. The pH of the tobacco material 122 may be higher than or equal to 8 to provide a significant amount of nicotine to a user.

The amount of nicotine delivered from the tobacco material 122 may increase with an in increase in a pH value of the tobacco material 122, but an excessive amount of nicotine may be released from the tobacco material 122, and thus the aerosol generating article 100 may not be easily stored and kept. In addition, when the pH value of the tobacco material 122 is higher than or equal to 10, off-flavor may occur from the aerosol generating article 100.

Therefore, with respect to storage and keeping of an aerosol generating article, prevention of occurrence of off-flavor, and a user's satisfaction with smoking, the pH value of the tobacco material 122 may be preferably within a range of 8 to 9.

Those of ordinary skill in the art related to the present embodiments may understand that various changes in form and details can be made therein without departing from the scope of the characteristics described above. Therefore, the disclosed methods should be considered in a descriptive point of view, not a restrictive point of view. The scope of the present disclosure is defined by the appended claims rather than by the foregoing description, and all differences within the scope of equivalents thereof should be construed as being included in the present disclosure.

The invention claimed is:

1. An aerosol generating article comprising:

a front-end plug configured to introduce external air into the aerosol generating article;

a tobacco medium portion including a tobacco material in a form of granules; and a filter unit arranged at a position opposite to the front-end plug across the tobacco medium portion, wherein a pH value of the tobacco material is 7 to 11, the tobacco medium portion includes at least one of an acetate filter and a paper filter, and the tobacco material in the form of granules is filled in the acetate filter or the paper filter, the paper filter has a rolled shape, and the tobacco material is filled in a gap between sheets of rolled paper of the paper filter.

2. The aerosol generating article of claim 1, wherein the pH value of the tobacco material is 8 to 9.

3. The aerosol generating article of claim 1, wherein the tobacco medium portion includes:

a first segment including the tobacco material; and a second segment including a cooling element.

4. The aerosol generating article of claim 3, wherein the cooling element includes at least one of a tube structure formed of a polylactic acid (PLA) sheet and a paper tube structure formed of paper.

5. The aerosol generating article of claim 3, wherein the first segment is arranged adjacent to the front-end plug, and the second segment is arranged adjacent to the filter unit.

6. The aerosol generating article of claim 3, wherein the first segment is arranged adjacent to the filter unit, and the second segment is arranged adjacent to the front-end plug.

7. The aerosol generating article of claim 1, wherein the tobacco material has a diameter of about 0.1 mm to about 1.2 mm.

8. The aerosol generating article of claim 1, wherein the tobacco material has a diameter of about 0.3 mm to about 0.6 mm.

9. An aerosol generating system comprising:

an aerosol generating article according to claim 1; and an aerosol generating device including an accommodation space for accommodating the aerosol generating article.

* * * * *